US006113502A

United States Patent [19]

Wilk

[11] Patent Number: 6,113,502

[45] Date of Patent: Sep. 5, 2000

[54] GOLF COURSE, GOLF PARK AND ASSOCIATED METHOD OF PLAYING A GOLF GAME

[76] Inventor: Peter J. Wilk, 185 W. End Ave., New York, N.Y. 10023

[21] Appl. No.: 09/293,109

[22] Filed: Apr. 16, 1999

Related U.S. Application Data

[62] Division of application No. 09/022,819, Feb. 12, 1998, Pat. No. 6,053,819.

[51] Int. Cl.[7] ..... A63B 69/36

[52] U.S. Cl. ..... 473/169; 473/409

[58] Field of Search ..... 473/131, 167, 473/168–170, 150, 158, 173, 409

[56] References Cited

U.S. PATENT DOCUMENTS

| | | | |
|---|---|---|---|
| 3,719,361 | 3/1973 | Rotolo | 473/169 |
| 4,189,152 | 2/1980 | Raber | 473/169 |
| 5,386,990 | 2/1995 | Smith | 473/131 |

FOREIGN PATENT DOCUMENTS

| | | | |
|---|---|---|---|
| 20139 | 2/1977 | Japan | 273/176 AB |

*Primary Examiner*—Mark S. Graham

*Attorney, Agent, or Firm*—R. Neil Sudol; Henry D. Coleman

[57] ABSTRACT

A golf course has a single fairway with multiple greens. At least two greens are provided, at opposite ends of the fairway. One or more additional greens may be provided between the first two greens and along the fairway. Also, multiple tees are provided for the one fairway. At least one tee is provided at each end of the fairway, the tee facing down the fairway towards the green at the opposite end of the fairway. Each green may be the target of two or more tees disposed at different locations on the fairway. The golf course is occupied for a predetermined limited period of time by an individual or a single group of golfers. The individual or single group of golfers plays back and forth along the fairway, for as long as they have reserved the course. They can play at their own pace, undisturbed by other golfers because there are no other golfers on the course. The only limitation is duration: eventually they will have to stop because their reserved interval of play has terminated.

10 Claims, 4 Drawing Sheets

GOLF COURSE, GOLF PARK AND ASSOCIATED METHOD OF PLAYING A GOLF GAME

This is a division of application Ser. No. 09/022,819 filed Feb. 12, 1998, U.S. Pat. No. 6,053,819.

BACKGROUND OF THE INVENTION

This invention relates to golf. More specifically, this invention relates to a new kind of golf course. Several golf courses in accordance with the invention may be incorporated into a golf park. This invention also relates to a method for playing a golf game.

Golf is a sport loved by millions world wide. Unfortunately for golf aficionados, golf has become so popular that courses have become markedly crowded. It is not uncommon for waiting times to be comparable to playing times. Waits are experienced not only prior to starting a golf game but during the game, at tees subsequent to the first one. Even if a particular course is not crowded at a certain time, frustration may nevertheless be occasioned one group of golfers by a another, slow group of golfers playing ahead. Conversely, one's enjoyment in the game can be considerably diminished by demands of following players to play more quickly. Beginners can be discouraged from playing the game, not only by pressures to minimize strokes and thus time on any particular hole, but also by exorbitant costs. High expense is especially rampant in countries such as Japan where land is at a premium.

OBJECTS OF THE INVENTION

An object of the present invention is to provide a golf course where an individual or a group can play golf at a desired pace, without encountering slower golfers in front or faster golfers behind.

Another object of the present invention is to provide a golf course wherein land usage is minimized, thereby enabling the play of golf even in areas where land is scarce.

A further object of the present invention is to provide a new method for playing a golf game.

These and other objects of the present invention will be apparent from the drawings and descriptions herein.

SUMMARY OF THE INVENTION

The foregoing objects are realized in a golf course comprising essentially a single fairway with multiple greens. At least two greens are provided, at opposite ends of the fairway. One or more additional greens may be provided between the first two greens and along the fairway. Also, multiple tees are provided for the one fairway. At least one tee is provided at each end of the fairway, the tee facing down the fairway towards the green at the opposite end of the fairway. Each green may be the target of two or more tees disposed at different locations on the fairway. The golf course is occupied for a predetermined limited period of time by an individual or a single group of golfers. The individual or single group of golfers plays back and forth along the fairway, for as long as they have reserved the course. They can play at their own pace, undisturbed by other golfers because there are no other golfers on the course. The only limitation is duration: eventually they will have to stop because their reserved interval of play has terminated.

In accordance with the present invention, the tees and the greens, as well as hazards disposed along the fairway, are so arranged as to present many different holes on the same fairway. The tee off location will vary depending on which tee one selects. In addition, the greens can be large enough to have multiple cups at substantially spaced locations.

Accordingly, a golf course in accordance with the present invention comprises a fairway having a first end and a second end. A first green is disposed at the first end of the fairway, while a second green is disposed at the second end of the fairway. Play is from the fairway onto the two greens. A first tee is disposed approximately at the first end of the fairway for play onto the fairway towards the second green. A second tee is disposed approximately at the second end of the fairway for play onto the fairway towards the first green. The fairway is the only fairway of the golf course and accommodates more than two holes of a golf game. Of course, a plurality of such single-fairway golf courses may be provided in proximity to one another. Such a collection of golf courses might be termed a "golf park."

According to another feature of the present invention, the golf course further comprises a third green disposed along the fairway intermediate between the first green and the second green, a third tee disposed approximately at the third green for play onto the fairway towards the first green, and a fourth tee disposed approximately at the third green for play onto the fairway towards the second green. The single-fairway golf course may additionally comprise a fifth tee disposed approximately at the first end of the fairway for play onto the fairway towards the third green and a sixth tee disposed approximately at the second end of the fairway for play onto the fairway towards the third green.

Pursuant to an additional feature of the present invention, each end of the fairway may be provided with multiple, relatively spaced tees for play towards the green at the other end of the fairway. Generally, one tee presents a shorter or easier hole while the other tee at the same end of the fairway presents a longer or harder hole.

Hazards may be provided along the single fairway which present different degrees of difficulty depending on which tee is used and which cup is being played. A hazard may be disposed in the fairway for dividing the fairway into substantially parallel portions each extending the length of the fairway. In that case, two tees at one end of the fairway may be disposed for play onto respective portions of the divided fairway.

According to a further feature of the present invention, a movable hazard is disposed along the fairway. The hazard is mounted to a carrier which may be towed by a truck or pulled by cables. The hazard may be removed from the fairway and replaced with a different hazard for varying the aspect and level of skill required by the course. Alternatively, the hazard may simply be moved to a different location on the course.

As discussed above a golf park may be created by providing several single-fairway golf courses in proximity to one another. The courses of such a golf park may be designed to present a varying level of difficulty.

In a method for playing golf in accordance with the present invention, a first golf ball is hit from a first tee onto a fairway from a first end of the fairway towards a first green disposed at a second end of the fairway opposite the first tee and the first end. That ball is then hit from the fairway onto the first green and into a first cup on the first green. Thereafter, a second golf ball (which may be same ball as the first) is hit from a second tee onto the fairway towards a second green disposed at the first end of the fairway. The second tee is disposed approximately at the second end of the fairway and the first tee is disposed approximately at the first end of the fairway. After the second golf ball is hit from the second tee onto the fairway, that ball is hit from the fairway onto the second green and into a second cup on the second green.

Play on the golf course may be extended by hitting a third golf ball from a tee at least approximately at one of the first end and the second end onto the fairway towards a third green disposed along the fairway intermediate between the first green and the second green. This ball is played into a cup on the third green. Then, a fourth golf ball (perhaps the same physical ball as the first, second and third golf balls) may be played onto the fairway towards one of the first green and the second green from a tee disposed substantially proximately to the third green.

A golf course in accordance with the present invention requires substantially less space than a traditional golf course. Land usage is minimized, thereby enabling the play of golf even in areas where land is scarce.

DESCRIPTION OF THE PREFERRED EMBODIMENTS

Figure 1:
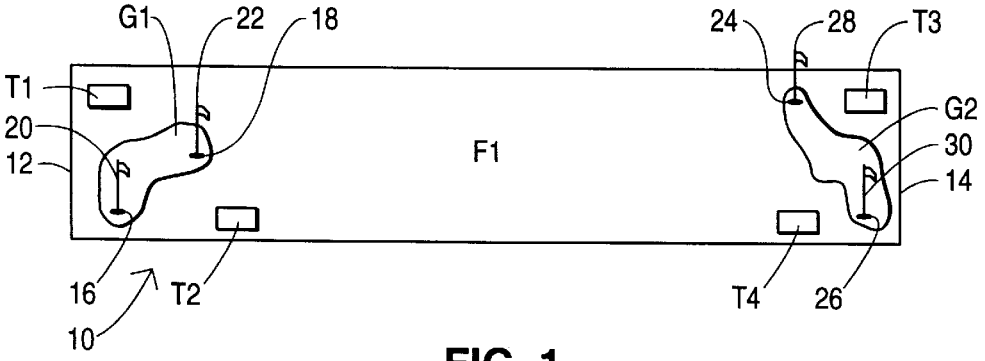
FIG. 1 is a plan view diagram of a single-fairway golf course in accordance with the present invention.

As illustrated in FIG. 1, a golf course 10 has a single fairway F1 which is provided at opposite ends 12 and 14 with two greens G1 and G2. Green G1 is provided with two cups 16 and 18 marked by respective flags or pins 20 and 22. Green G2 is similarly provided with two cups 24 and 26 marked by pins 28 and 30. Two mutually spaced tees T1 and T2 are provided at fairway end 12, and two mutually spaced tees T3 and T4 are provided at end 14.

In playing a golf game on course 10, a player hits a golf ball (not shown), for example, from tee T1 onto fairway F1. The player then hits the ball from fairway F1 onto green G2 and into a selected cup 24 or 26. Subsequently, the player hits either the same ball or another ball from a tee T3 or T4. This second tee may be selected by the player or may be preselected in accordance with a predetermined agenda. If all of the holes (identified by respective combinations of tees and cups) are preselected by agenda, the player can more easily check his performance with predetermined par standards.

The player continues in the above described manner, selecting different tees and different cups to vary the lengths and aspects of a sequence of golf holes. Generally, a single player or a single group of players exclusively occupies golf course 10 for an assigned or reserved period. The single player or group of players is free of slower players in front of them and faster players behind them.

Figure 2:
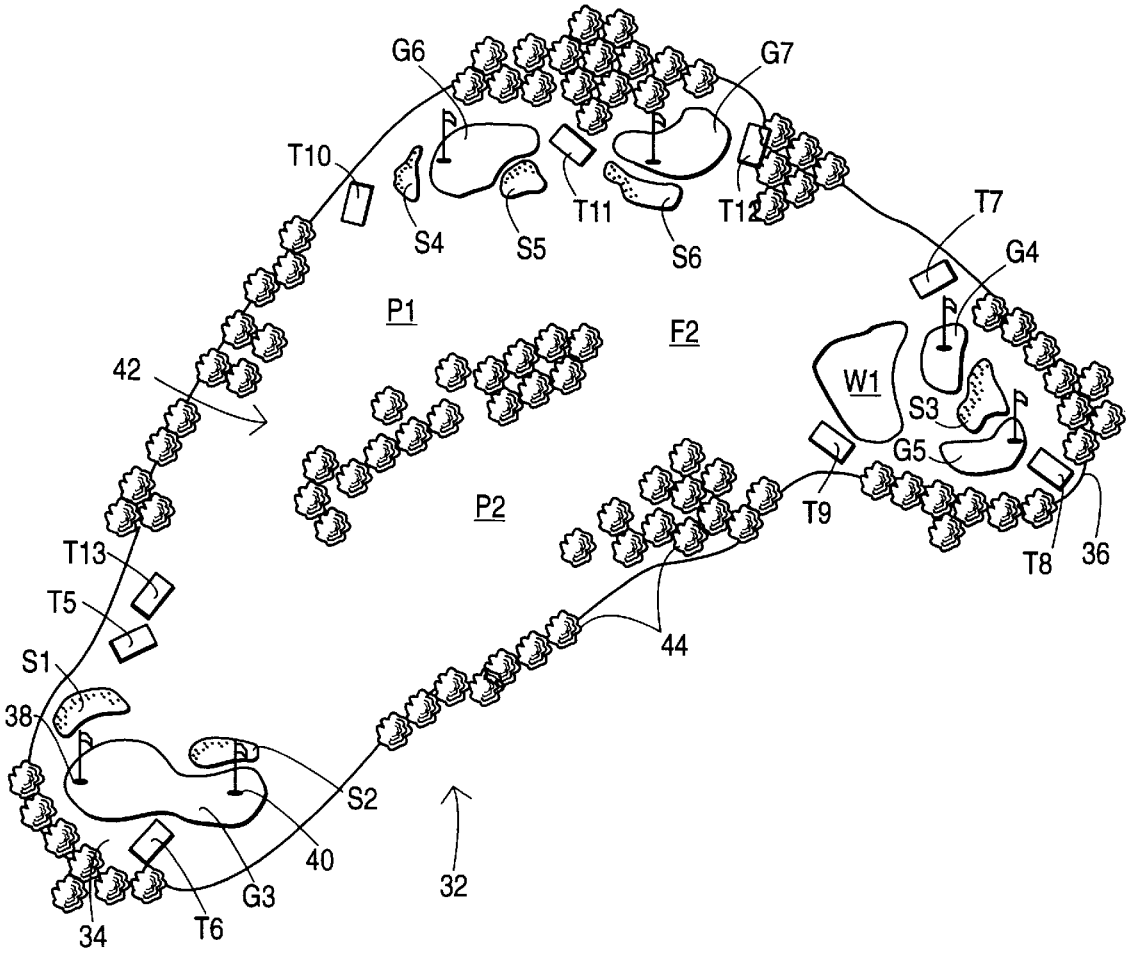
FIG. 2 is a plan view diagram of another single-fairway golf course in accordance with the present invention.

FIG. 2 illustrates some of the variety which may be introduced into a single-fairway golf course or multiple green fairway in accordance with the invention. A golf course 32 shown in FIG. 2 includes a single fairway F2 with a dog-leg shape. A first end 34 of fairway F2 or course 32 is provided with a green G3 and pair of tees T5 and T6 aimed generally down fairway F2 towards two greens G4 and G5 located at an opposite end 36 of fairway F2. At that opposite end 36 are provided two tees T7 and T8 for play onto fairway F2 back towards green G3. A further tee T9 is provided at fairway end 36 for play onto fairway F2 towards a pair of additional greens G6 and G7 disposed at an intermediate location along fairway F2. Yet another tee T9 at fairway end 36 is aimed at green G6. A plurality of tees T10, T11 and T12 are provided in the area of greens G6 and G7 for play onto fairway F2 either towards green G3 or greens G4 and G5. Another tee T13 at green G3 is provided for play towards any of greens G4–G7.

Substantial variation in the holes playable on course 32 is presented by the different greens and tees. Further variation is introduced by providing multiple cups on the different greens. Green G3, for example, has cups 38 and 40. For purposes of simplicity, the pins at cups 38 and 40 and the cups and pins on greens G4–G7 are not labeled with reference designations. As in conventional single-green fairways, hazards such as sand traps S1–S6 and a water hazard W1 may be provided on course 32. A hazard such as a copse of trees 42 is disposed substantially centrally along fairway F2 for dividing the fairway into two generally parallel portions P1 and P2. Other trees 44 are disposed about the periphery of fairway F2.

In playing a golf game on course 32, a player hits a golf ball (not shown), for example, from tee T5 onto fairway F2 and more particularly onto fairway portion P2. The player then hits the ball from fairway portion P2 onto green G4 or G5 and into a selected cup on the respective green. For the next hole, the player hits either the same ball or another ball from tee T7 back towards green G3 along fairway portion P2, from tee T8 towards green G3 along fairway portion P1, from tee T8 towards green G6 or G7 along fairway F2, or from tee T9. If green G3 is the target green on this second hole, the player may select either cup 38 or 40.

After playing to green G6 or G7, the player or group of players may select tee T10 for play onto fairway portion P1 towards green G3, tee T12 for play onto fairway portion P2 towards green G3, or tee T11 for play onto fairway F2 towards green G4 or G5. After playing to green G3, the player or group of players may select tee T13 for play onto fairway portion P1 towards green G4, G5, G6 or G7. Alternatively, the player or players may tee off from tee T5 or T6 onto fairway portion P2 towards greens G4 or G5. Again, the tees, greens and cups selected by the player or golf group may be pursuant to a predetermined standard sequence of holes for golf course 32. Of course, following golf conventions, each combination of tee, fairway portion, green and cup may be assigned a par value for facilitating gauging a players performance.

Figure 3:
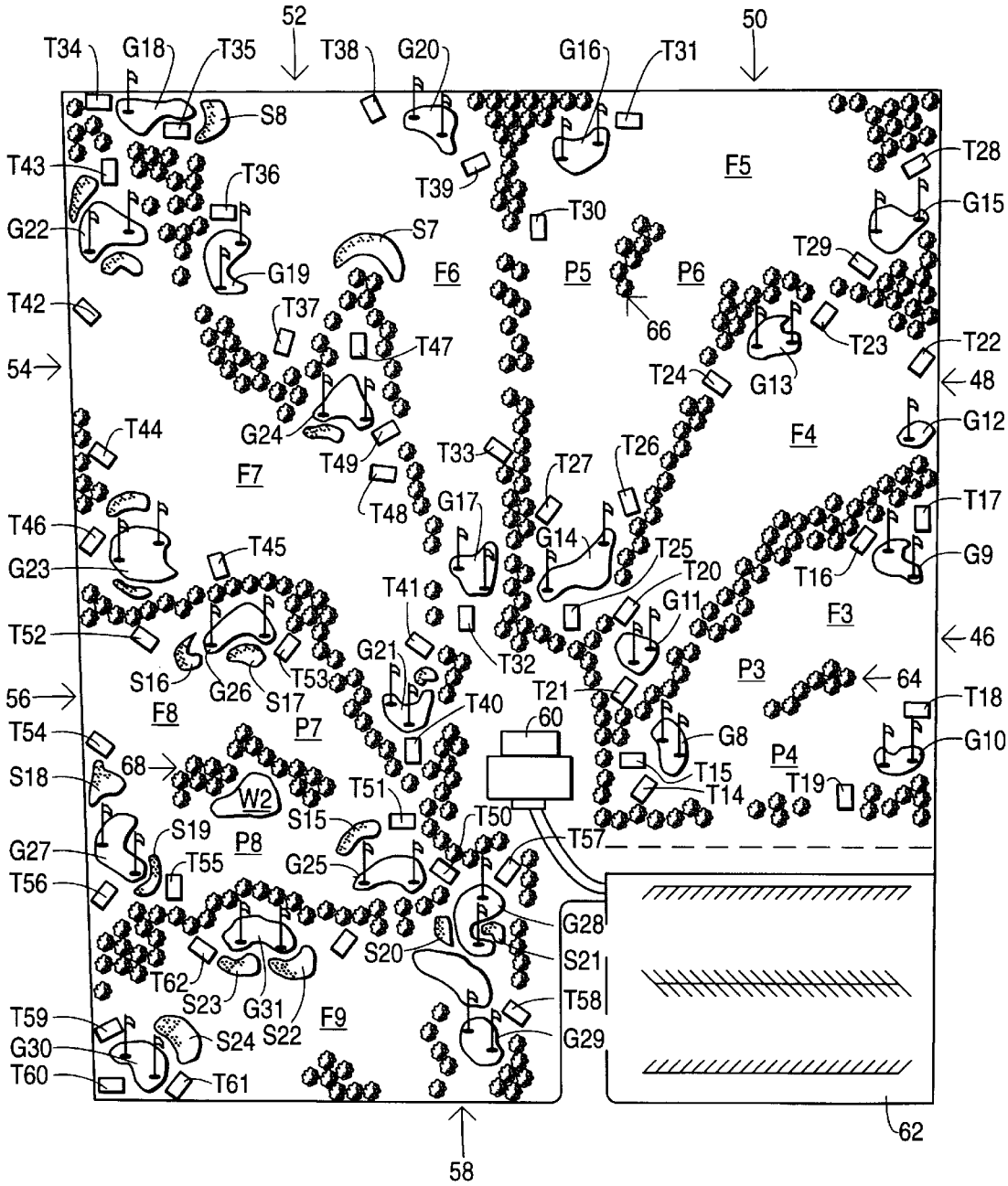
FIG. 3 is a plan view diagram of a park including several single-fairway golf courses in accordance with the present invention.

FIG. 3 depicts a golf park incorporating several single-fairway golf courses 46, 48, 50, 52, 54, 56, and 58 having respective fairways F3–F9. Courses 46, 48, 50, 52, 54, 56, and 58 may have varying levels of difficulty determined generally by the nature and numbers of hazards. The golf park also has a centrally located administrative building or clubhouse 60 and a parking lot 62.

Fairway F3 of course 46 is provided with a centrally located floral or arboreal hazard 64 which divides fairway F3 into two parallel portions P3 and P4. A first green G8 is located at one end of fairway F3, a second green G9 at an opposite end, and a third green G10 at an intermediate position. Two tees T14 and T15 at green G8 are aimed at respective fairway portions P3 and P4 and concomitantly at respective greens G9 and G10. Two further tees T16 and T17 are disposed at green G9 for play onto fairway F3 towards greens G8 and G10, respectively. Two additional tees T18 and T19 are provided at green G10 to enable players to tee off onto fairway F3 towards greens G8 and G9, respectively. Each green G8, G9, G10 is provided with two or more cups (not labeled), marked by pins (not labeled). Course 46 is designed to be relatively easy to play. Fairway F3 is level and devoid of hazards, with the exception of floral or arboreal hazard 64.

Course 48 includes three greens G11, G12, and G13 and five tees T20 through T24. Greens G11 and G12 are provided at opposite ends of fairway F4; green G13 is disposed at an intermediate location. Tees T20 and T21 are aimed towards greens G12 and G13, respectively, while tees T22 and T23 are aimed towards green G11 and tee T24 is aimed towards green G12. Fairway F4 is level and completely devoid of hazards so that course 48 presents a modicum of difficulty.

Course 50 includes three greens G14, G15, and G16 and seven tees T25 through T31. Greens G14 and G15 are provided at the far ends of fairway F5, while fairway G16 is located in between. A hazard 66, such as a pond, a sand trap, a copse of trees or bushes or an artificial structure such as a sculpture, is disposed substantially centrally in fairway FS and effectively divides that fairway into two portions P5 and P6. Tees T25 and T26, located next to green G14, point towards green G16 along fairway portion P5 Tee T27, also near green G14, is directed towards green G15 along fairway portion P6. Tees T28 and T29 are provided near green G15 and are designed for play onto fairway F5 towards greens G14 and G16, respectively. Tees T30 and T31, at an intermediate location, enable play towards greens G14 and G16, respectively. Each green is provided with two cups and associated pins (not designated). Course 50 is longer and therefore more difficult than course 46.

Course 52 has four greens G17–G20. Greens G17 and G18 are the farthest apart and concomitantly by definition are located at opposite ends of fairway F6. Greens G19 and G20 are located along fairway F6 between greens G17 and G18. Associated with each green G17–G20 is a respective pair of tees, namely, tees T32 and T33, T34 and T35, T36 and T37, and T38 and T39. Tees T32 and T33, disposed at the near or proximal end of fairway F6 in the neighborhood of green G17, may be used to play holes associated with either green G18 or G19. Tee 32 may also be used to play towards green T20. Tees T34 and T35, disposed at the far or distal end of fairway F6 in the neighborhood of green G18, are oriented along fairway F6 in the direction of greens G20 and G17, respectively. Tees T36 and T37, near green G19, are disposed for pay onto fairway F6 towards greens G17 and G20, respectively. Tees T38 and T39, beside green G20, are for play towards greens G17 and G19, respectively. Course 52 is of greater difficulty than course 50, particularly since course 52 is provided with sand trap hazards S7 and S8.

Like course 52, course 54 has four greens G21–G24. Green G21 is located at a proximal end of the course, near clubhouse 60, while green G22 is located at a distal end of course 54, farthest from clubhouse 60. Greens G23 and G24 are located between greens G21 and G22 along fairway F7. Disposed in the area of proximal green G21 are two tees T40 and T41, for play towards greens G24 and G22, respectively. A tee T42 near green G22 may be used for play onto fairway F7 towards green G21 or G24. Another tee T43 behind green G22 is used for play towards green G23. Green G23 is itself associated with three tees T44–T46 which are directed towards greens G21, G22 and G24, respectively. Another three tees T47–T49 are located about green G24 for enabling teeing off towards greens G21, G22 and G23, respectively. Sand traps S9–S14 are provided for increasing the level of play required on course 54. As in other courses of the golf park of FIG. 3, each green G21–G24 has at least two cups and associated pins (not labeled) for providing enhanced variation. One skilled in the art will appreciate that each greens G21–G24 may have different levels and inclined sections, with the cups being located at different areas to enhance hole difficulty.

Course 56 includes three greens G25–G27, seven tees T50–T57, several sand traps S15–S19, a water hazard W2 and a mid-fairway arboreal hazard 68. Course 56 is generally triangularly shaped. In such a case, two greens, for example, greens G25 and G26, will be spaced from one another by a greater distance than greens G25 and G27 or greens G26 and G27. Greens G25 and G26 are then located by definition at opposing ends of fairway F8, while green G27 is considered to be located along fairway F8 between the other two greens. Water hazard W2 and arboreal hazard 68 divide fairway F8 into two portions P7 and P8.

Course 58 includes four greens G28–G31, several tees T57–T62, sand traps S20–S24, a water hazard W3 and arboreal hazards 70 and 72. Greens G28 and 29 are located at a proximal end of fairway F9 or course 58, near clubhouse 60, while green G30 is disposed at a distal end of fairway F9 and green G31 is located midway along fairway F9. Tees T57 and T58, at the proximal end of course 58, are aimed at greens G30 and G31, respectively, while tees T59–T61, at the distal end of the course, are oriented in the directions of greens G28, G29 and G31, respectively. Tee T62 near green G31 is pointed towards green G29.

Courses 54, 56 and 58 require a high level of skill, owing to the various hazards on those courses. The golf park has a multitude of trees 70 and other vegetation for defining courses 46, 48, 50, 52, 54, and 56. Other means of separating the different golf courses may include walls or fences.

Figure 4A:
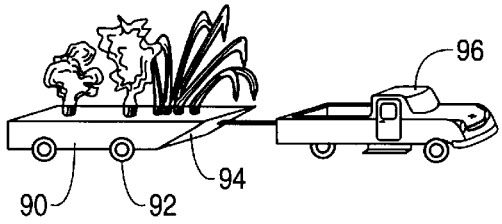
FIG. 4A is a schematic perspective view of a method for moving a hazard in accordance with the invention.
Figure 4:
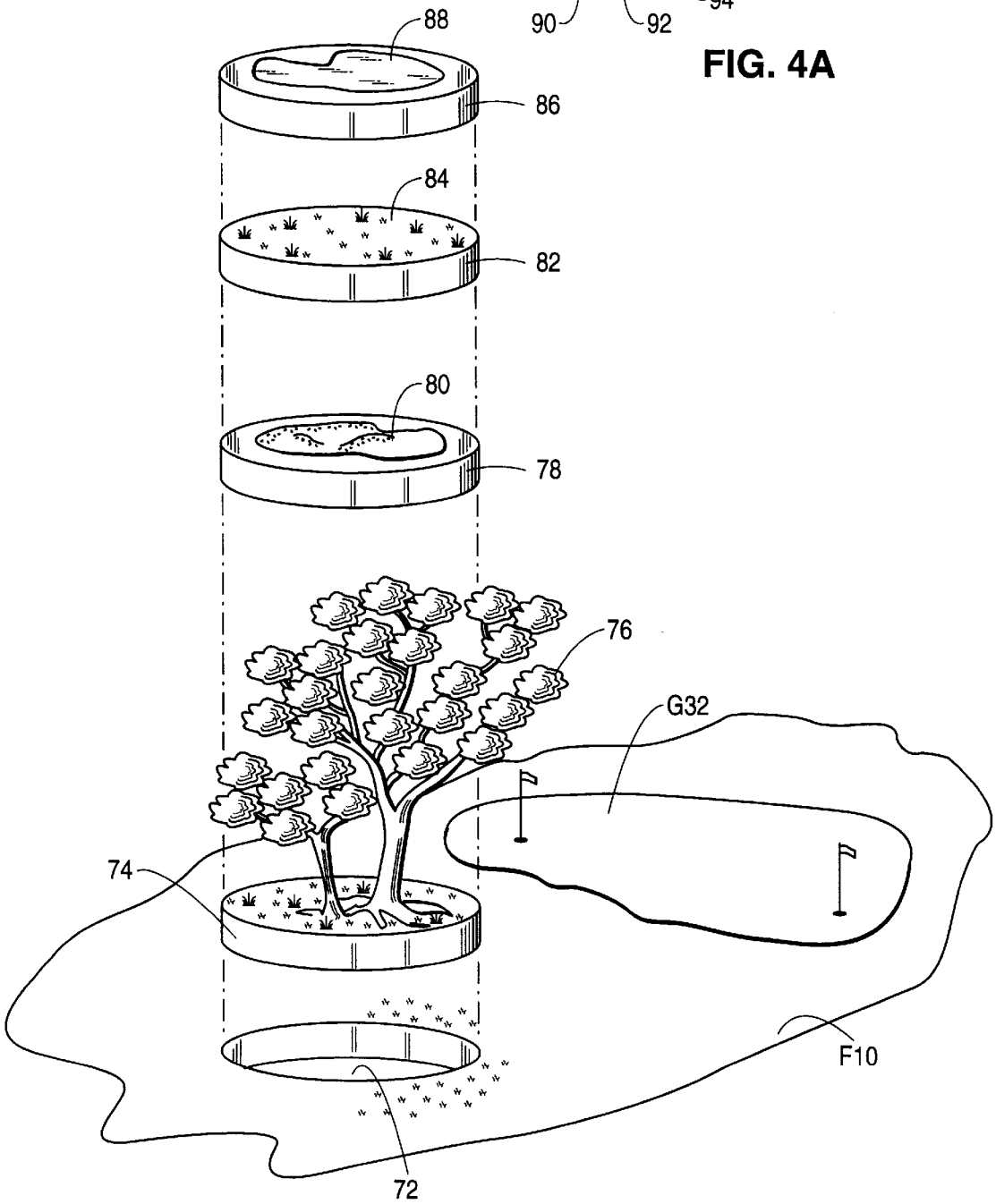
FIG. 4 is a perspective diagram showing a plurality of movable hazards substitutable for one another in a recess in accordance with the present invention, for use in a golf course as shown in FIGS. 1–3.

FIG. 4 schematically illustrates a technique for modifying a golf course, particularly a single-fairway golf course as described hereinabove. A fairway F10 having a green G32 is provided with a recess 72 of a fixed shape for receiving a removable container 74. Container 74 has a shape which conforms to recess 72 so that container 74 may be inserted into recess 72. Container 74 holds a hazard such as a tree 76. Container 74 with tree 74 may be removed from recess 72 and replaced with a container 78 holding a sand trap 80, a container 82 holding turf 84, or a container 86 holding a water hazard 88. Containers 78, 82 and 86 are substantially identical to container 74 and are likewise removably receivable into recess 72 for varying the difficulty of a golf hole played on fairway F10 to green G32.

As depicted in FIG. 4A, a hazard container 90 may be provided with wheels 92 and an inclined wall 94 conforming to an inclined surface of a recess (not shown) in a golf course fairway. The inclined surface of the recess facilitates the use of a truck 96 to move container 90 into and out of the recess in the fairway. In contrast, containers 74, 78, 82 and 86 (FIG. 4) require the use of a crane (not shown) or other lifting device to raise the containers out of recess 72.

Figure 5:
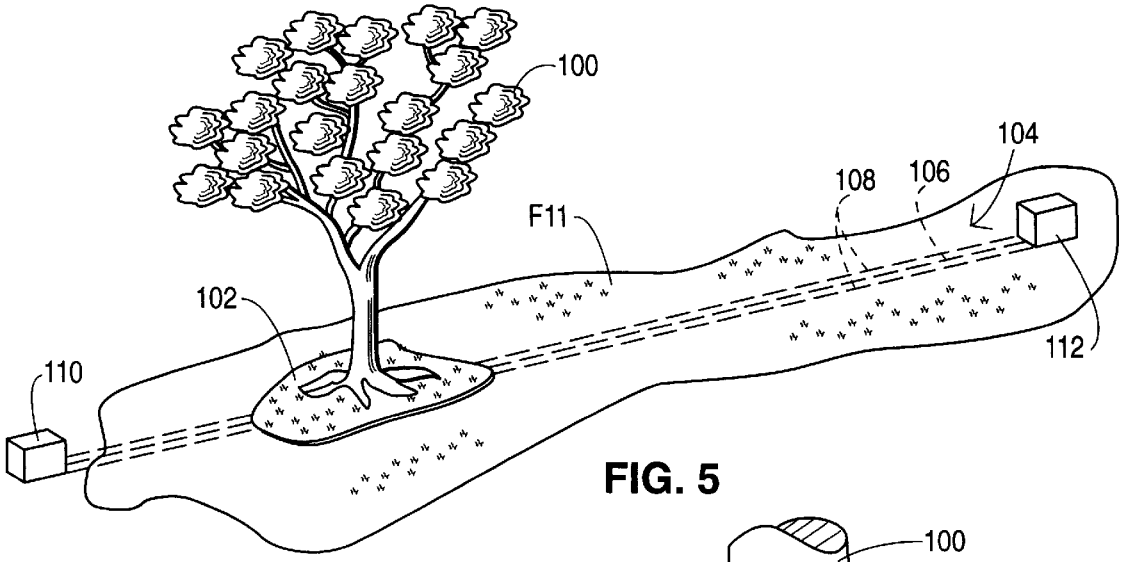
FIG. 5 is a diagram of a movable hazard in accordance with the present invention, for use in a golf course as shown in FIGS. 1–3.

FIG. 5 shows another technique for modifying a golf course to vary the level of play required. A hazard 100, such as a tree, is mounted to a movable platform or carrier 102. Carrier 102 is covered with dirt and turf and otherwise conforms to a fairway F11 on which the carrier and hazard 100 are disposed. A generally underground cable and track system 104 is provided for shifting carrier 102 and its hazard 100 along a pre-established path on fairway F11. System 104 includes a cable 106 and a pair of rail assemblies 108. Cable 106 is fastened along an intermediate point to carrier 102 and at ends of the travel path to sheaves (not shown) driven by motors 110 and 112.

Figure 6:
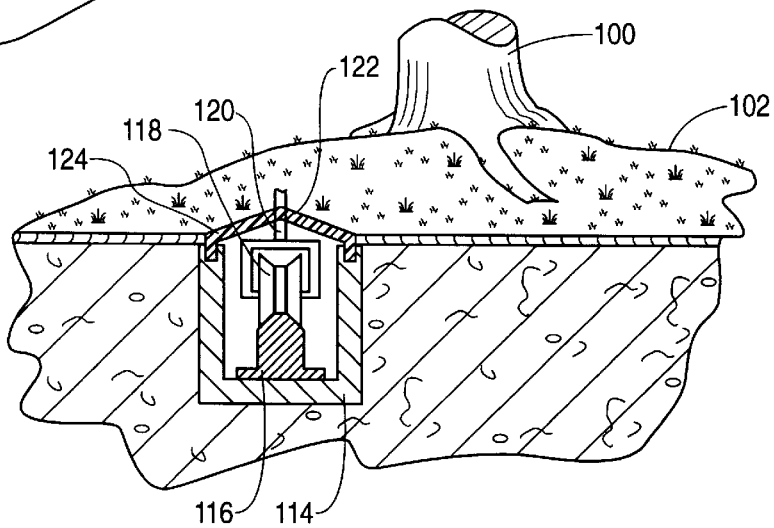
FIG. 6 is a schematic vertical cross-sectional view showing a portion of a transport system for the movable hazard of FIG. 5.

As illustrated in FIG. 6, a rail assembly 108 includes a channel member 114 housing a rail 116 on which a plurality of wheels 118 ride (only one wheel shown). Carrier 102 is supported on wheels 118 by respective struts 120. Struts 120 extend through a slit 122 between two resilient lips 124. Lips 124 are angled to close slit 122 around struts 120 and to prevent golf balls from falling into channel member 114.

Figure 7A:
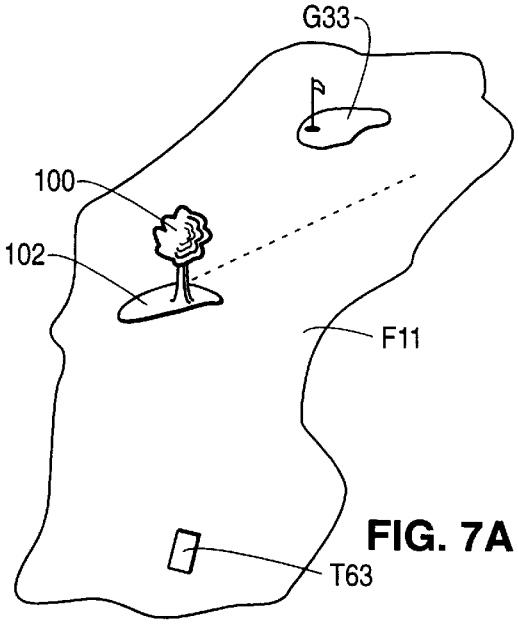
FIG. 7A is a schematic partial perspective view of a golf course with the movable hazard of FIG. 5, showing the hazard in one location.
Figure 7B:
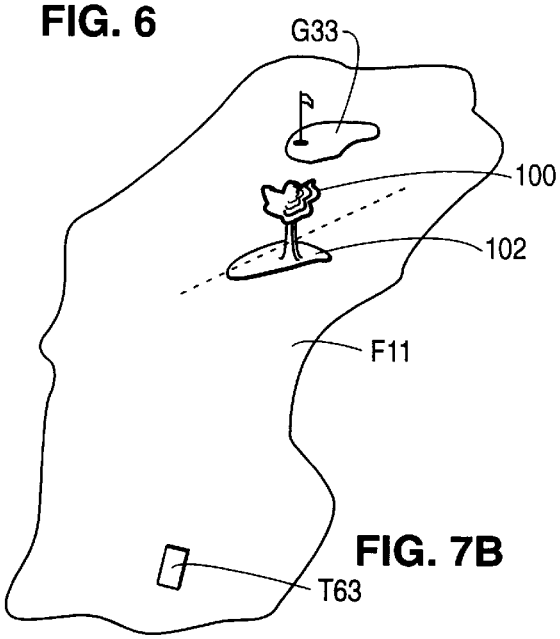
FIG. 7B is a schematic partial perspective view similar to FIG. 7A, showing the hazard in another location.

FIGS. 7A and 7B show fairway F11, a green G33, a tee T63 and hazard 100 on carrier 102. In FIG. 7A, carrier 102 and hazard 100 are disposed in one location. In FIG. 7B, the carrier and the hazard are disposed in another location after shifting thereof by cable and track system 104.

It is to be noted that the hazard replacement or hazard shifting systems of FIGS. 4 through 7B can be utilized in conventional multiple-fairway golf courses as well as in the single-fairway courses of the present invention.

It is contemplated that a single-fairway golf course as described above will be used for a predetermined standard period such as one hour. At the end of that standard period, the player or players will depart from the course by walking or taking a golf cart along a path (not shown) disposed along a longitudinal boundary of the fairway. The end of the standard period may be communicated to the players by an acoustic alert signal or a verbal message generated via speakers at various locations throughout the course. Video cameras may be provided throughout the course for security and time enforcement purposes. Video images from the cameras can be displayed at a central location, for example, at clubhouse 60.

Although the invention has been described in terms of particular embodiments and applications, one of ordinary skill in the art, in light of this teaching, can generate additional embodiments and modifications without departing from the spirit of or exceeding the scope of the claimed invention. Accordingly, it is to be understood that the drawings and descriptions herein are proffered by way of example to facilitate comprehension of the invention and should not be construed to limit the scope thereof.

What is claimed is:

1. A method for playing golf, comprising:

hitting a first golf ball from a first tee onto a fairway from a first end of said fairway towards a first green disposed at a second end of said fairway opposite said first tee and said first end;

hitting said golf ball from said fairway onto said first green and into a first cup on said first green;

after hitting said golf ball into said first cup, hitting a second golf ball from a second tee onto said fairway towards a second green disposed at said first end of said fairway, said second tee being disposed approximately at said second end of said fairway and said first tee being disposed approximately at said first end of said fairway;

after hitting said second golf ball from said second tee onto said fairway, hitting said second golf ball from said fairway onto said second green and into a second cup on said second greene;

hitting a third golf ball from a tee at least approximately at one of said first end and said second end onto said fairway towards a third green disposed along said fairway intermediate between said first green and said second green;

hitting said third golf ball from said fairway onto said third green and into a third cup on said third green;

hitting a fourth golf ball onto said fairway towards one of said first green and said second green from a tee disposed substantially proximately to said third green; and hitting said fourth golf ball from said fairway onto said one of said first green and said second green.

2. The method defined in claim 1 wherein said first golf ball and said second golf ball are the same golf ball.

3. A method for playing golf comprising:

entering a golf course in a party often five individuals, said golf course including a single fairway;

hitting a golf ball in one direction along a fairway provided with a plurality of greens essentially disposed at opposite ends of said fairway;

hitting said ball into a cup on one of said greens;

playing golf in an opposing direction along said fairway towards another of said greens;

continuing to play golf on said fairway exclusively in said party of fewer than five individuals, alternately in said one direction towards said one of said greens and in said opposing direction towards said another of said greens; and terminating play on said fairway after lapse of a predetermined, arbitrary period independent of time required to play any given number of holes on said fairway.

4. A golf method comprising:

providing a golf park having a first golf course and a second golf course, each of said first golf course and said second golf course including only a single fairway;

having a first party of fewer than five individuals exclusively play a first golf game on said first golf course;

substantially simultaneously having a second party of fewer that individuals exclusively play a second golf game on said second golf course;

having said first party terminate said first golf game after a first predetermined arbitrary period of play independent of time required to play any given number of holes on said first golf course; and having said second party terminate said second golf game after a second predetermined arbitrary period of play independent of time required to play any given number of holes on said second golf course.

5. The method defined in claim 4 wherein said first predetermined period and said second predetermined period have the same duration.

6. The method defined in claim 4 wherein said first golf game includes:

hitting a golf ball in one direction along a fairway provided with a plurality of greens;

hitting said ball into a cup on one of said greens;

playing golf in an opposing direction along said fairway towards another of said greens;

continuing to play golf on said fairway alternately in said one direction towards said one of said greens and in said opposing direction towards said another of said greens.

7. A golf method comprising:

providing a golf course having only a single fairway;

allowing a first selected party of fewer than five individuals access to said golf course at a commencement time;

during a first predetermined arbitrary period of time beginning at said commencement time, preventing other parties from access to said golf course, so that said selected party has exclusive use of said golf course for said period of time;

requiring said party to exit said golf course at termination of said period of time to thereby enable start of a second predetermined arbitrary period of time during which a second selected party of fewer than five individuals has exclusive use of said golf course.

8. The method defined in claim 7 wherein said golf course includes a single fairway, at least one first green at one end of said fairway, at least one second green at an opposite end of said fairway, at least one first tee at said one end of said fairway, and at least one second tee at said opposite end of said fairway, further comprising having said first selected party play in alternately opposite directions along the said fairway during said period of time.

9. A golf method comprising;

providing a golf park having a first golf course and a second golf course, said first golf course and said second golf course each having only a single fairway;

having a first party of fewer than five individuals play golf on said first golf course exclusively of other golf parties during a first predetermined arbitrary period of play;

substantially simultaneously having a second party of fewer than five individuals play golf on said second golf course exclusively of other golf parties during a second predetermined arbitrary period of play;

having said first party terminate golf play after said first predetermined arbitrary period of play; and having said second party terminate golf play after said second predetermined arbitrary period of play.

10. The method defined in claim 9 wherein said first golf course and said second golf course each comprises a single fairway, at least one first green at one end of said fairway, at least one second green at an opposite end of said fairway, at least one first tee at said one end of said fairway, and at least one second tee at said opposite end of said fairway, the playing of golf by said first party on said first golf course including having said first party play in alternately opposite directions along the respective fairway during said first predetermined arbitrary period of play, the playing of golf by said second party on said second golf course including having said second party play in alternately opposite directions along the respective fairway during said second predetermined arbitrary period of play.

* * * * *

UNITED STATES PATENT AND TRADEMARK OFFICE

CERTIFICATE OF CORRECTION

PATENT NO. : 6,113,502

DATED : September 5, 2000

INVENTOR(S) : Peter J. Wilk

It is certified that error appears in the above-identified patent and that said Letters Patent is hereby corrected as shown below:

Column 2, line 54, change "above" to -- above, --.

Column 5, line 39, change "FS" to -- F5 -- ; line 42, change "P5 Tee" to -- P5. Tee --.

Claim 1, line 11, change "greene;" to -- green; --.

Claim 3, line 2, change "often" to -- of fewer than --; line 16, change "predetermined," to -- predetermined --.

Claim 4, line 8, change "that" to -- than five --.

Signed and Sealed this

Seventeenth Day of April, 2001

*Attest:*

Nicholas P. Godici

NICHOLAS P. GODICI

*Attesting Officer*

*Acting Director of the United States Patent and Trademark Office*